US009482480B2

(12) United States Patent
O'Dell

(10) Patent No.: US 9,482,480 B2
(45) Date of Patent: Nov. 1, 2016

(54) BOLT HOLD-OPEN SYSTEM AND METHOD

(71) Applicant: John Roy O'Dell, Beatty, NV (US)

(72) Inventor: John Roy O'Dell, Beatty, NV (US)

( * ) Notice: Subject to any disclaimer, the term of this patent is extended or adjusted under 35 U.S.C. 154(b) by 0 days.

(21) Appl. No.: 14/306,219

(22) Filed: Jun. 16, 2014

(65) Prior Publication Data

US 2015/0198400 A1 Jul. 16, 2015

Related U.S. Application Data

(60) Provisional application No. 61/835,633, filed on Jun. 16, 2013.

(51) Int. Cl.
*F41A 17/36* (2006.01)

(52) U.S. Cl.
CPC ..... *F41A 17/36* (2013.01)

(58) Field of Classification Search
CPC ..... F41A 17/36; F41A 17/42; F41A 9/70; F41A 17/66; F41A 19/43; F41A 3/12; F41A 17/00; F41A 17/34; F41A 17/46; F41A 19/30
USPC ..... 42/18; 89/138
See application file for complete search history.

(56) References Cited

U.S. PATENT DOCUMENTS 834,354 A 10/1906 Ashton
1,178,468 A * 4/1916 Hartigan ..... F41A 3/56 42/22
1,344,991 A * 6/1920 Cunningham ..... F41A 3/26 42/16
2,321,045 A * 6/1943 Roemer ..... F41A 17/36 89/138
3,098,311 A * 7/1963 Savioli ..... F41A 17/36 42/18
3,540,142 A * 11/1970 Billett ..... F41A 7/02 42/18
3,846,928 A * 11/1974 Ruger ..... F41A 17/36 42/16
4,128,042 A * 12/1978 Atchisson ..... F41A 3/26 89/138
6,510,778 B1 * 1/2003 Irwin ..... F41A 17/36 42/16
7,261,029 B1 * 8/2007 Davis ..... F41A 17/36 42/16
7,596,900 B2 * 10/2009 Robinson ..... F41A 33/06 42/49.01
8,327,749 B2 * 12/2012 Underwood ..... F41A 9/59 42/18
8,387,296 B2 * 3/2013 Overstreet ..... F41A 9/70 42/50
8,650,787 B2 * 2/2014 McCormick ..... F41A 17/36 42/18
8,985,005 B1 * 3/2015 Dubois ..... F41A 17/32 89/128
2005/0000138 A1 * 1/2005 Kiss ..... F41A 17/36 42/50
2005/0011345 A1 * 1/2005 Herring ..... F41A 5/26 89/1.4
2011/0056107 A1 * 3/2011 Underwood ..... F41A 9/59 42/18
2011/0247483 A1 * 10/2011 Overstreet ..... F41A 9/70 89/138
2011/0283580 A1 * 11/2011 Esch ..... F41A 17/42 42/14
2014/0060310 A1 * 3/2014 Overstreet ..... F41A 3/68 89/138

* cited by examiner

*Primary Examiner* — Troy Chambers
*Assistant Examiner* — Bridget Cochran
(74) *Attorney, Agent, or Firm* — Connie R. Masters

(57) ABSTRACT

The bolt hold-open system is a firearm bolt locking or holding mechanism for an AK-47 or similar firearm capable of automatically keeping the bolt of the firearm in an open position when the firearm magazine is empty. The bolt hold-open system includes a locking assembly and a modified magazine. The bolt hold-open system also provides a manual control for keeping the bolt in an open position and for releasing the bolt. The system prevents the bolt carrier from closing while there is an empty magazine in the gun, but can be easily activated to release the bolt when the magazine is removed or a non-empty magazine is in the magazine receiver. The system requires minimal modifications to the firearm and magazine and is easily adaptable to firearms similar to the AK-47 that fire ammunition in a wide range of calibers and configurations.

15 Claims, 10 Drawing Sheets

BOLT HOLD-OPEN SYSTEM AND METHOD

CROSS-REFERENCE TO RELATED APPLICATIONS

This nonprovisional application claims the benefit of co-pending U.S. Provisional Patent Application Ser. No. 61/835,633, filed on Jun. 16, 2013, which is incorporated herein in its entirety.

FIELD OF INVENTION

The present invention relates to the general technical field of firearms, and particularly to a system for locking the bolt of the firearm in an open position, and specifically to an economical and easily installed bolt hold-open system including a modified magazine for AK-47 firearms and firearms that are variants of the AK-47.

BACKGROUND OF THE INVENTION

The AK-47, or Kalashnikov rifle, is one of the most common firearms globally. Its simple and reliable design makes it economical to manufacture and easy to maintain in the field. While the AK-47 is a versatile weapon, it does lack some features that would improve its usefulness in combat.

One of the most problematic gaps in the AK-47's design is the lack of an automatic bolt hold-open. When the last cartridge in the firearm's magazine is spent, the bolt returns to the closed position without picking up a cartridge. After replacing the empty magazine with a full magazine, it is necessary to manually pull back the bolt to chamber the first cartridge of the new magazine. Although this action only requires a few seconds, it is distracting and annoying, or worse in the case where every second counts. Additionally, when at a shooting range, range officers may at times require the bolt to be held in the open position for safety so a bolt hold-open would be beneficial.

A mechanism that would automatically hold the bolt open when the last round was ejected from the magazine, while allowing the bolt to be easily released when a new magazine is in place, would remove the necessity of manually chambering the new round, would satisfy shooting range regulations, and would provide a significant advantage in speed and convenience of changing magazines. Such a device would also minimize mental distraction, allowing the firearm user to direct more of his or her attention to the surroundings.

U.S. Pat. No. 7,261,029 issued to Davis provides a bolt hold-open for an AK-47, but the system disclosed by Davis requires the modification of the bolt carrier, the receiver carrier, and the magazine. A system that limits modifications to the gun is preferable, since it allows the use of a wider variety of replacement parts. Furthermore, the bolt hold-open release mechanism of the system provided in Davis cannot be activated by the trigger hand since the mechanism is high on the gun, and the Davis bolt hold-open can only be released on one side of the gun. A system which allowed the locking mechanism to be released by the trigger hand would be preferable, as would a system that could be easily operated either left- or right-handed.

Other available retrofit bolt hold-open devices do not hold the bolt fully open.

Accordingly, there is a need for a bold hold-open system that holds the bolt within the bolt carrier fully open, can be operated with either hand, can be accessed with the trigger hand, and requires no more than minimal modification to the gun.

SUMMARY OF THE INVENTION

The bolt hold-open system of the present invention provides the ability to add a full bolt hold-open to an AK-47, AD-47 variants, and similar guns. The bolt hold-open system includes a locking assembly and a modified magazine. The locking assembly provides a magazine lever that is raised when a modified magazine with a magazine tab is emptied. The magazine lever causes a bolt catch lever to rise into the path of the rifle bolt carrier, preventing it from returning to the closed position. An activator lever disposed on the exterior of the firearm is connected by a connector lever to the bolt catch lever and can be activated manually to release the bolt hold-open locking mechanism or to engage it manually.

Variations are presented in both the modified magazine and in the locking assembly. These allow the bolt hold-open system to be readily used with the several variants of AK-47 guns, including guns particularly configured to meet specific state laws.

The bolt hold-open system of the present invention is easily adaptable to guns with a wide variety of calibers and requires minimal or no modifications to the gun itself. Furthermore, existing magazines can be easily adapted to work with this bolt hold-open locking mechanism with minimal changes, and the locking assembly does not interfere with the operation of the gun when unmodified magazines are used.

BRIEF DESCRIPTION OF THE DRAWINGS

The preferred embodiments of the invention will hereinafter be described in conjunction with the appended drawings, provided to illustrate and not to limit the invention, where like designations denote like elements.

DETAILED DESCRIPTION OF THE PREFERRED EMBODIMENTS

In an unmodified firearm, the action of pulling the trigger will release a spring-loaded hammer, which will rise up and strike a firing pin. If a cartridge is in the chamber of the gun, the firing pin will strike the cartridge primer, igniting the powder charge in the cartridge. The force generated by the explosion of the powder charge will send the bullet forward out the barrel of the gun and will at the same time push the bolt backward far enough to eject the spent cartridge. The bolt is then pushed forward again by the action of the return spring, and as the bolt returns to the starting position it picks up and chambers the next cartridge from the magazine. If there are no additional cartridges in the magazine, the bolt returns to the starting position without loading a cartridge into the chamber, and upon replacement of the magazine the bolt must be manually operated to load the first cartridge into the chamber.

Figure 6:
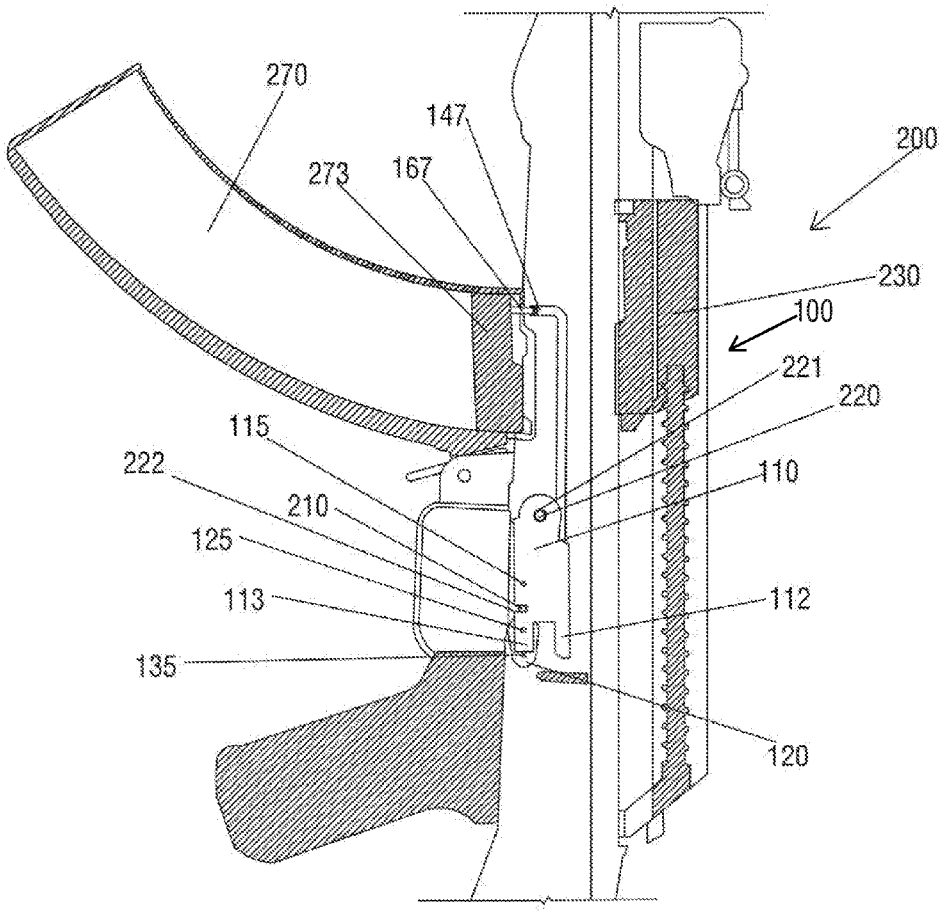
FIG. 6 is a left side cut view of a firearm showing a second embodiment of the locking mechanism (locking assembly) and a second variation of a firearm magazine modified to be compatible with firearms that do not afford the addition of a rear tab on the magazine.
Figure 7:
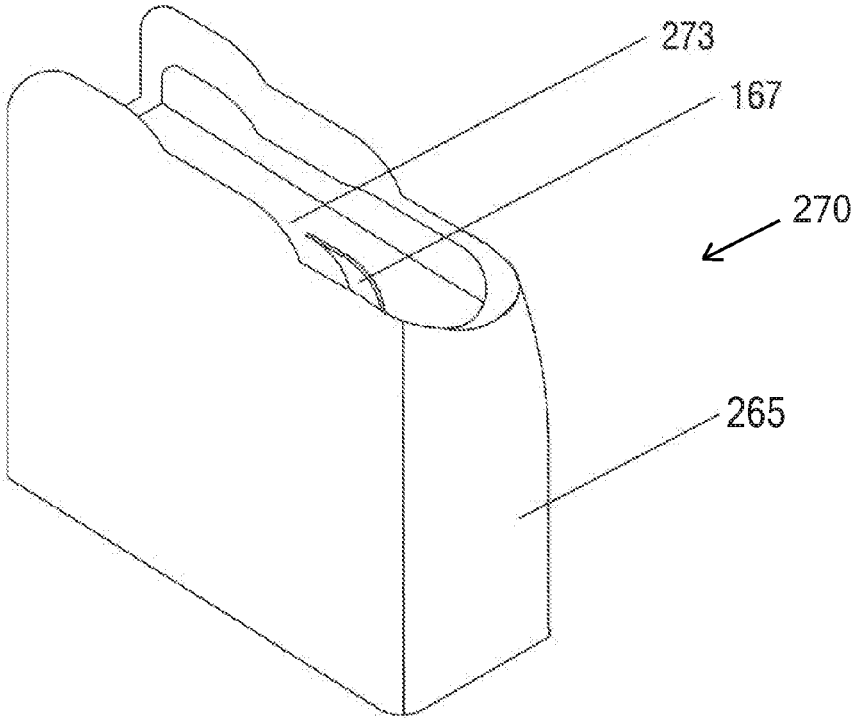
FIG. 7 is a perspective view of the second variation of the firearm magazine modified to be compatible with a second embodiment of the present invention.
Figure 10:
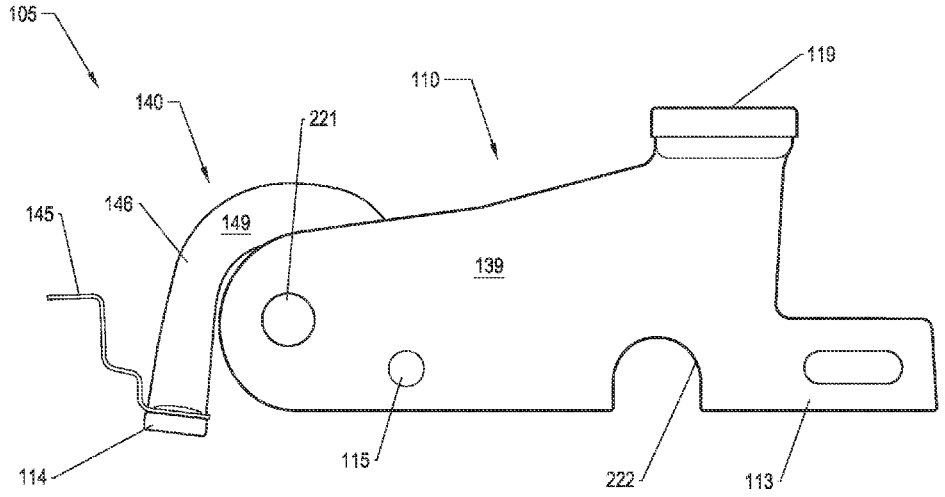
FIG. 10 is a left side view of the locking mechanism of a third embodiment of the present invention from the left side of the firearm.
Figure 11:
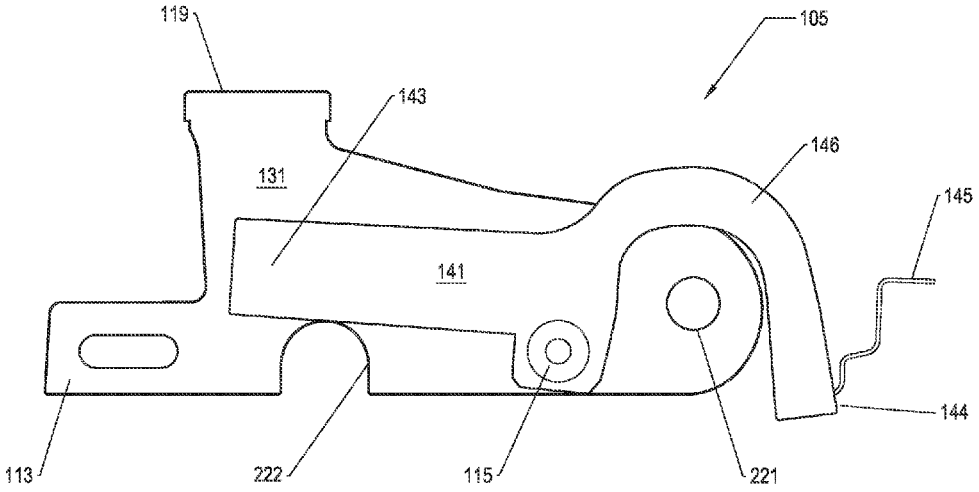
FIG. 11 is a right side view of the locking mechanism of the third embodiment of the present invention from the right side of the firearm.
Figure 12:
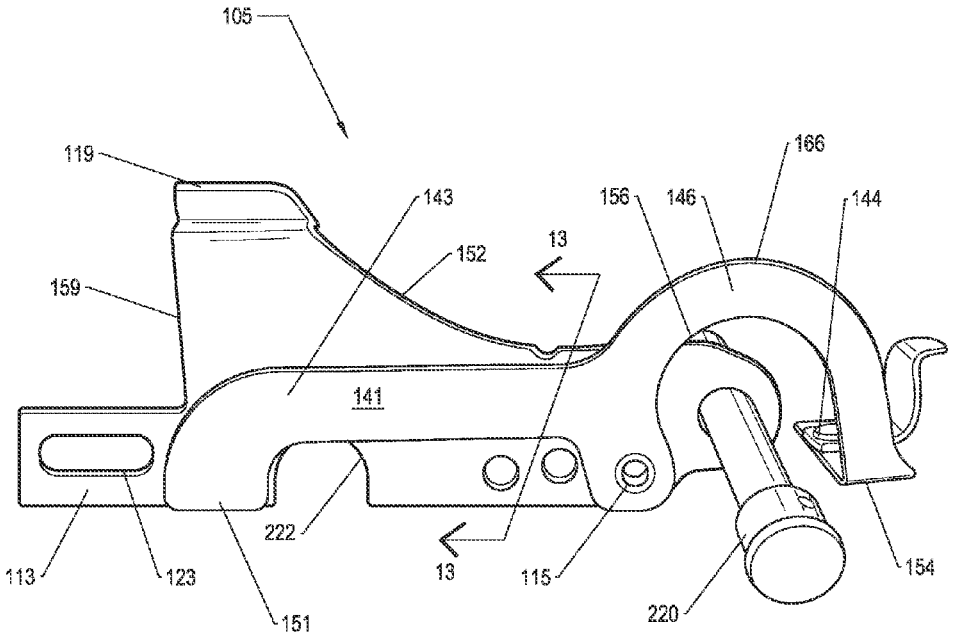
FIG. 12 is a right perspective view of the locking mechanism of the third embodiment of the present invention.
Figure 13:
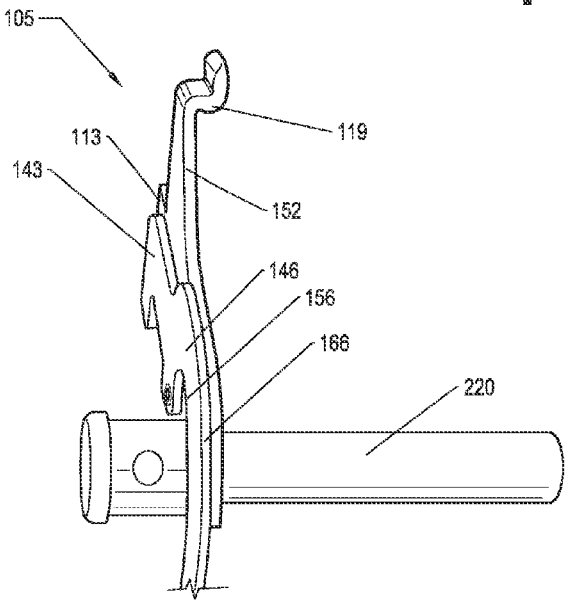
FIG. 13 is a partial perspective view of one end of the locking mechanism of the third embodiment of the present invention.

The bolt hold-open system of the present invention, shown generally as reference number 100 (FIG. 6), prevents the bolt from returning to the starting position when the last cartridge is fired from a modified magazine. The bolt hold-open system includes both a locking assembly 105 (FIGS. 8-9) and a modified magazine 260 (FIG. 5), 270 (FIG. 7). The locking assembly 105 provides a magazine lever 140 that is raised when the modified magazine 260, 270 with a magazine tab 165 (FIG. 5), 167 (FIG. 7) is emptied. The magazine lever 140 causes an upper carrier-interacting portion 112 (FIGS. 8-9), 119 (FIGS. 10-11) of a bolt catch lever no to rise into the path of the rifle bolt carrier 230 (FIGS. 1, 4, 6), preventing it from returning to the closed position. In the first embodiment, the upper carrier-interacting portion 112 of bolt catch lever no rises to interact with the knob on the back of the carrier 230, while in the third embodiment, the upper carrier-interacting portion 119 of bolt catch lever no is designed to catch on the front of the carrier 230. A manual activator lever 130 disposed on the exterior of the firearm is connected by a manual connector lever 120 to the bolt catch lever no and can be activated manually to release the locking assembly 105 or to engage it manually.

Figure 1:
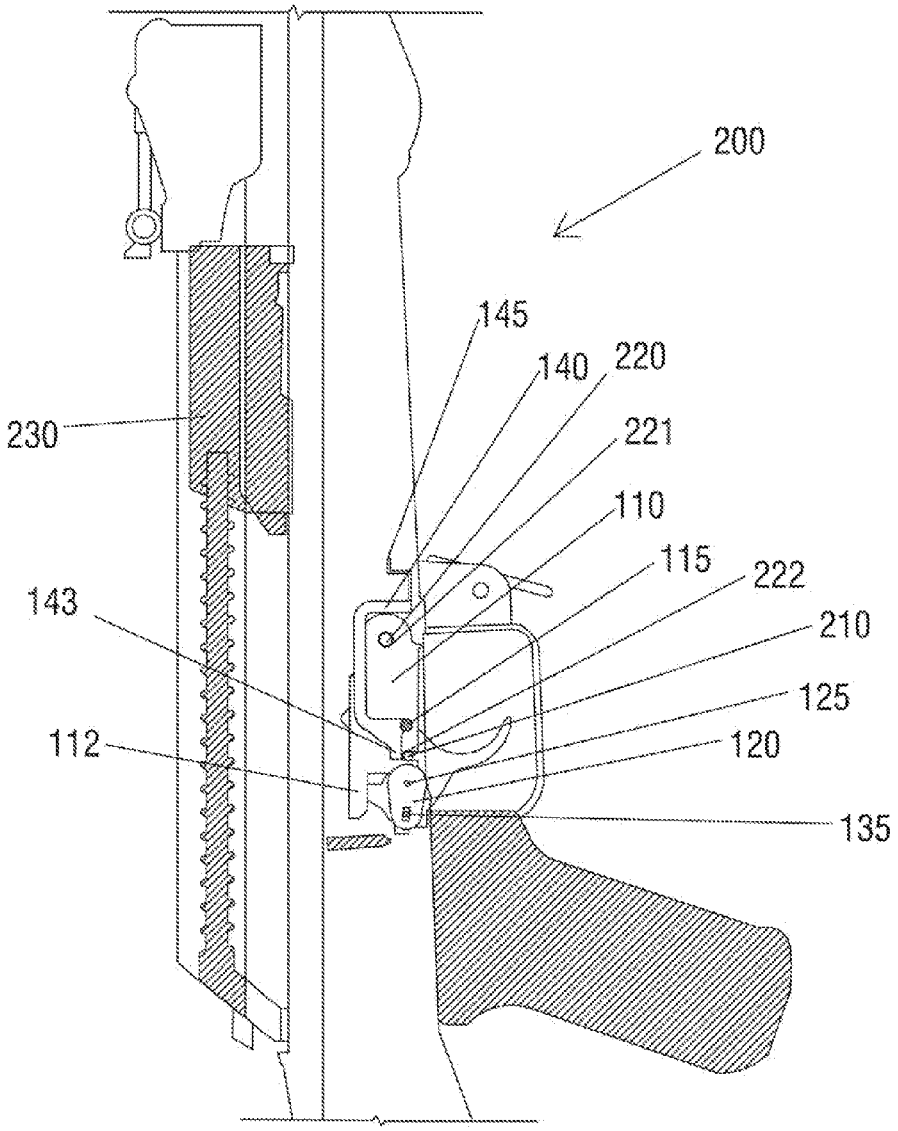
FIG. 1 is a right side cut view showing a first embodiment of the present invention mounted in a firearm from the right side of the firearm.

Now in detail, referring to cut view FIG. 1, the bolt hold-open system 100 is depicted installed in a gun. The bolt hold-open system 100 of the current invention is shown mounted as a modification to a standard AK-47, but can be used as a modification to a wide variety of different AK-47 variants and can be used alongside many common AK-47 modifications.

Figure 4:
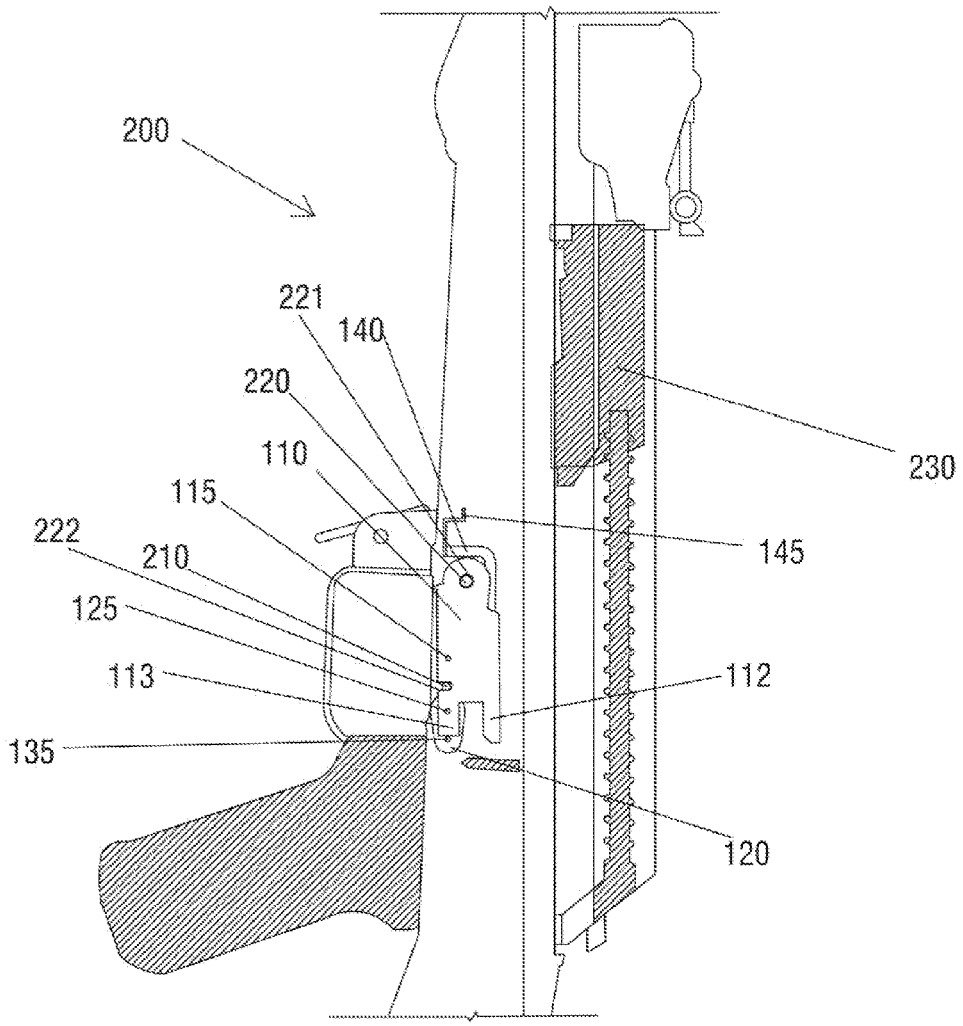
FIG. 4 is a left side cut view showing the first embodiment of the present invention mounted in a firearm from the left side of the firearm.
Figure 8:
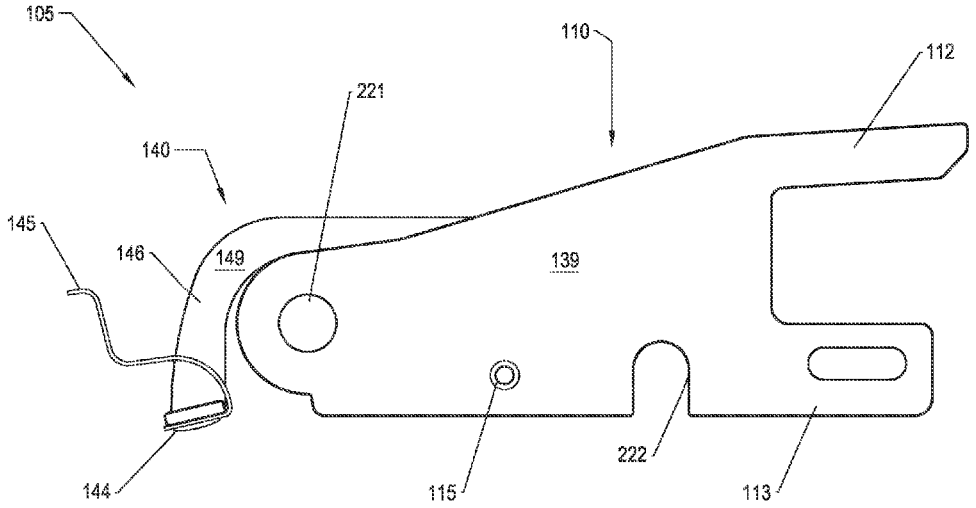
FIG. 8 is a left side view of the locking mechanism of the first embodiment of the present invention from the left side of the firearm.
Figure 9:
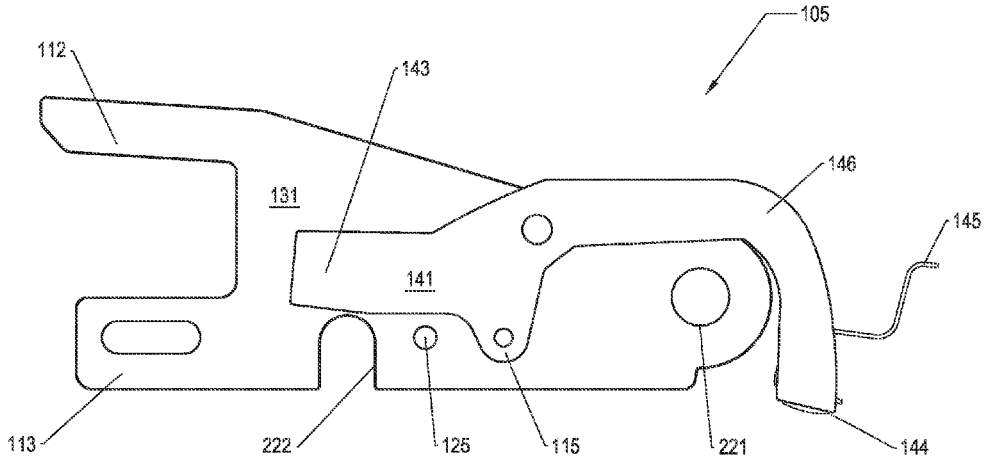
FIG. 9 is a right side view of the locking mechanism of the first embodiment of the present invention from the right side of the firearm.

As seen in FIG. 1 and the detail views of FIGS. 8-9, the piece of the locking assembly that engages the rifle bolt carrier 230 is the upper carrier-interacting portion 112 of the bolt catch lever no. The bolt catch lever no is a relatively thin metal sheet, particularly shaped with apertures, cut-outs and pivot points. The bolt catch lever no is shaped with an aperture 221 around hammer pivot pin 220 toward the front configured to allow the bolt catch lever no to rotate around the hammer pivot pin 220 (FIG. 1). The hammer pin aperture, defined by generally circular edge 221 (FIG. 8), is sized and shaped to accommodate the hammer pivot pin 220. The rear end of the bolt catch lever no of the first embodiment is shaped into two rearwardly projecting portions or projections, the upper carrier-interacting portion 112 and a lower prong 113 (FIGS. 4, 8, 9).

The prongs form the upper and lower rearward end of the bolt catch lever 110 disposed rearward of magazine lever pivot 115 and rearward of edge 222. The bolt catch lever 110 is split into two prongs to avoid interfering with the operation of the safety tab of the gun. In order to install the locking assembly 105 it may be necessary to trim off a small amount of metal from the top right of the safety device.

The bolt catch lever 110 has a trigger pin cut-out defined by trigger pin cut-out edge 222 on the lower side spaced as necessary for gun model variations to allow the bolt catch lever no to rotate freely without engaging with the trigger pivot pin 210. The bolt catch lever no also has a magazine lever pivot 115 mounted forward of the trigger pivot pin 210. The bolt catch lever lower prong 113 (FIG. 4) is attached to the front end of a connector lever 120 (FIG. 1) at a connector lever pivot 125. The connector lever 120 is non-rotatably connected at the rear end to an activator lever 130 (FIG. 2) at an activator lever connector 135. The activator lever connector 135 passes through a hole in the gun casing 250 (FIG. 2) and thus the activator lever 130 (FIG. 2) is disposed on the exterior of the gun 200. Many firearm variants provide an unused hole in this position, and the connector lever 120 can be sized appropriately for the firearm to use a preexisting hole, however, if a hole is not provided it is necessary to drill the hole in the gun casing 250 (FIG. 2) for the activator lever connector 135 to pass through.

A magazine lever 140 is rotatably connected to bolt catch lever no at the magazine lever pivot 115. The magazine lever 140 extends rearward from the magazine lever pivot 115 so that the rear tab 143 (FIG. 8) of the magazine lever 140 rests on the trigger pivot pin 210 (FIG. 1). The magazine lever 140 also extends forward in somewhat of an arc 146 from the magazine lever pivot 115, over the hammer pivot pin 220, then down to distal end 144 to lie substantially along the bottom casing of the gun 200. Surface 149 is adjacent to the bolt catch lever no, as shown in FIG. 8.

A magazine catch 145 extends upward then forward in a roughly "L"-shaped form from the distal end 144 of bolt catch lever 110. The magazine catch 145 is configured so that the magazine tab 165 (FIG. 5) mounted on the magazine follower 263 (FIG. 5) will raise the magazine catch 145 when the magazine 260 (FIG. 5) is emptied. When the magazine catch 145 is raised by the magazine tab 165 the magazine lever 140 will act as a second class lever with the magazine lever rear tab 143 resting on the trigger pivot pin 210 serving as a fulcrum, causing the magazine lever pivot 115 to rise. Since the magazine lever pivot 115 connects to the bolt catch lever 110, the bolt catch lever will be rotated upward with the hammer pivot pin 220 serving as a fulcrum. This will cause the bolt catch lever upper carrier-interacting portion 112 to move upward into the path of the bolt carrier 230 carrying the bolt, preventing it from returning to the starting position. After the magazine 260 (FIG. 5) is ejected, the magazine tab 165 (FIG. 5) will no longer be holding the bolt catch lever 110 in place, but the tension of the bolt carrier 230 pressing on the bolt catch lever upper carrier-interacting portion 112 will keep the bolt catch lever 110 in place until the activator lever 130 (FIG. 2) is pressed down. When the activator lever 130 (FIG. 2) is pressed down, it will rotate causing the connector lever 120 (FIG. 1) to rotate as well. The connector lever 120 is connected at the forward end to the bolt catch lever lower prong 113 (FIG. 4), so the rotation of the connector lever 120 will cause the bolt catch lever 110 to rotate downward around the hammer pivot pin 220. This downward rotation will cause the bolt catch lever upper carrier-interacting portion 112 to lower out of the path of the bolt carrier 230, allowing the bolt carried by bolt carrier 230 to return to its starting position. If a new magazine 260 (FIG. 5) is inserted before activating the activator lever 130, the bolt will load the first cartridge from the new magazine into the chamber while returning to a closed position, in accordance with its typical functionality.

Figure 2:
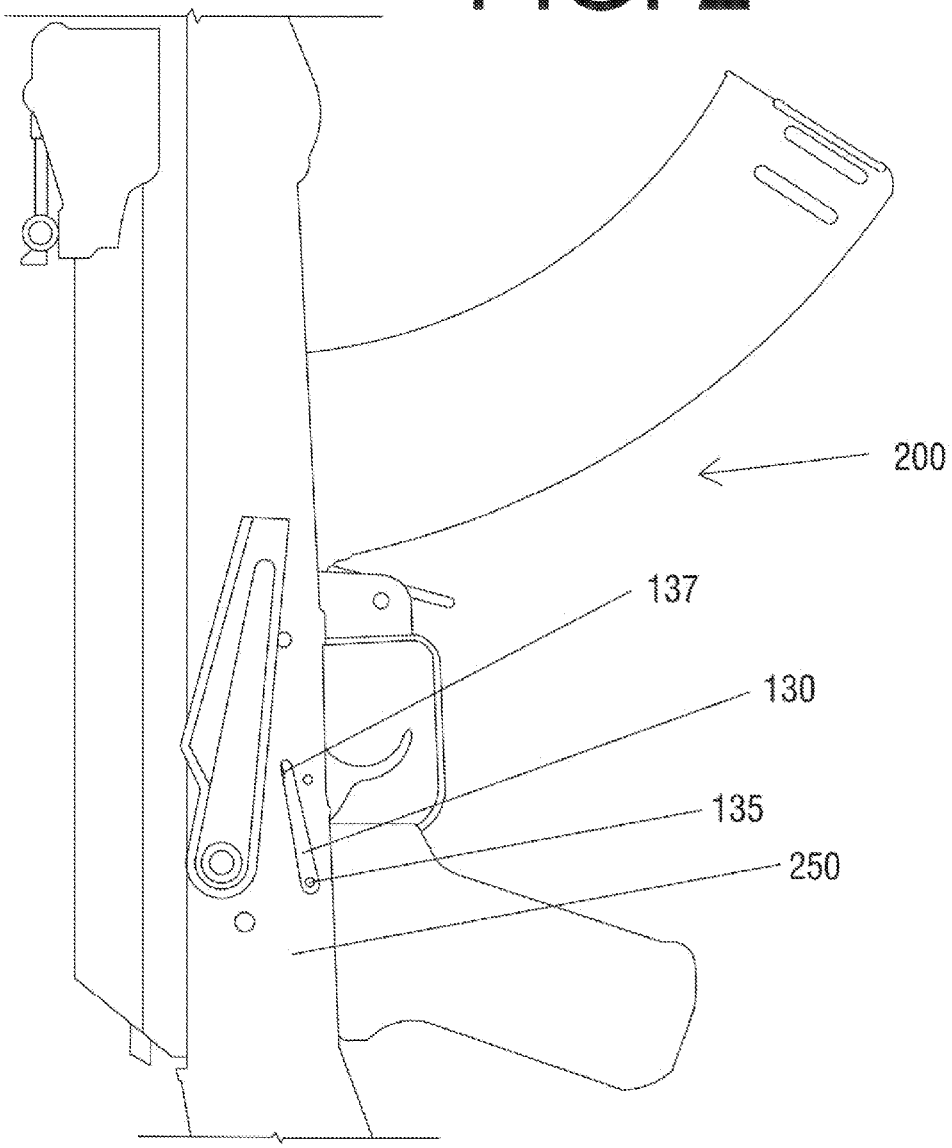
FIG. 2 is an exterior right side view showing a first aspect of the first embodiment of the present invention from the right side of the firearm.

FIG. 2 illustrates the exterior of a gun fitted with the bolt hold-open of the current invention. An activator lever 130 is attached to the activator lever connector 135 which extends through the gun housing 250. The activator lever 130 is elongated and extends toward the front of the gun. The forward end of the activator lever 130 is molded into a finger grip 137 that extends away from the gun body to allow the activator lever 130 to be easily activated by a shooter's finger.

Figure 3:
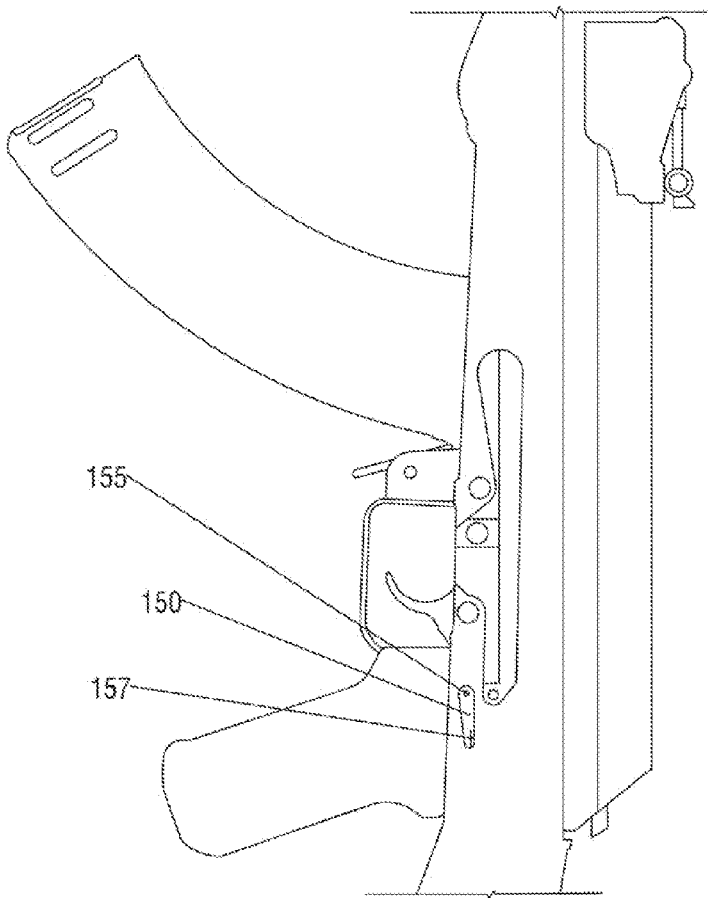
FIG. 3 is an exterior left side view showing a second aspect of the first embodiment of the present invention from the left side of the firearm.

FIG. 3 depicts an exterior view of a second aspect of the first embodiment of the bold hold-open of the current invention. In this aspect of the invention, the activator lever connector 135 is configured to extend across the body of the gun and through an aperture in the left side of the gun housing 250 to form a left-side activator lever connector 155. The left-side activator lever connector 155 is non-rotatably connected to the left-side activator 150. The left-side activator lever 150 can be configured to extend forward or rearward from the left-side activator lever connector 155, but is shown in this embodiment extending rearward from the left-side activator lever connector 155. The end of the left-side activator lever 150 opposite the left-side activator lever connector 155 is molded into a left-side finger grip 157 that extends away from the gun body to allow the left-side activator lever 150 to be easily activated by a right-handed shooter's thumb or a left-handed shooter's finger. The left-side activator lever 150 (FIG. 3) can be used in addition to or in replacement of the activator lever 130 (FIG. 2) on the right side of a gun. In the case where it is used in addition to the activator lever 130 (FIG. 2), the holes for the left-side activator lever connector 155 (FIG. 3) and the right-side activator lever connector 135 (FIG. 2) must be aligned so that the left-side activator lever connector 155 (FIG. 3) and the right-side activator lever connector 135 (FIG. 2) are co-linear and non-rotatably connected. In this case, the left-side activator lever connector 155 (FIG. 3) and the right-side activator lever connector 135 (FIG. 2) may be preferably formed as a single component.

FIG. 4 provides a cut view from the left side of the gun. The bolt catch lever lower prong 113 is visible in this view, in addition to the components discussed in FIG. 2.

Figure 5:
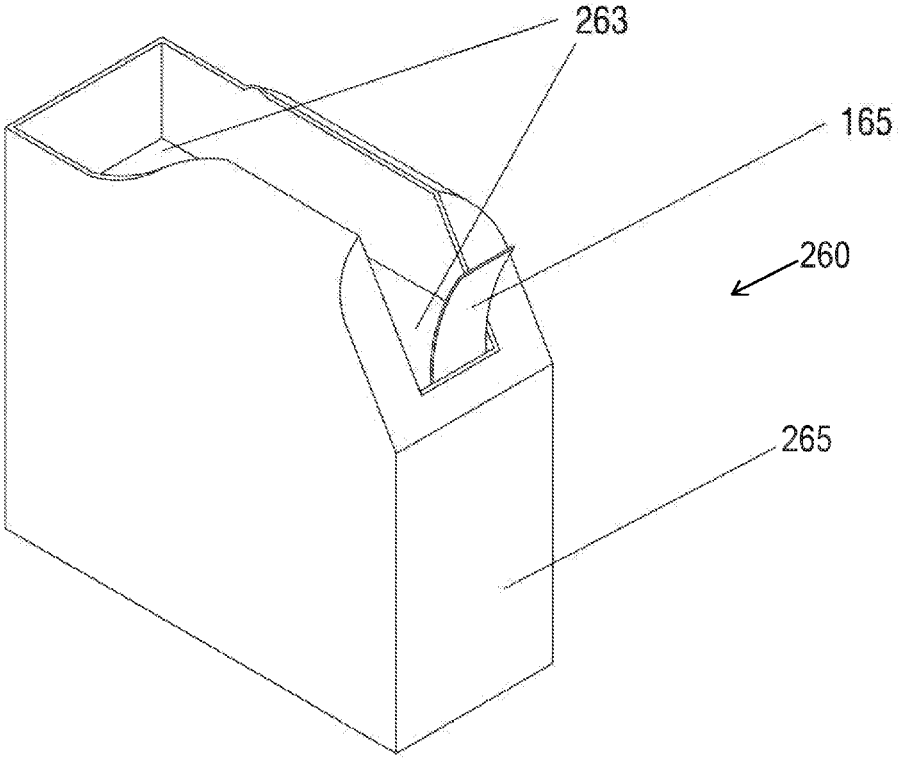
FIG. 5 is a perspective view of a first variation of a firearm magazine modified to be compatible with the first or third embodiment of the present invention.

FIG. 5 illustrates a first modified magazine 260 modified to work with the bolt hold-open of the current invention. The modified magazine 260 is a standard magazine (compatible with the modified firearm) having a body 265 with the addition of a magazine tab 165 attached to the rear of the magazine follower 263. The magazine tab 165 is configured to extend in an arc upward and back at an angle to engage with the magazine catch 145 (FIGS. 1, 4, 8, 9) when an empty magazine 260 is inserted into the firearm 200. When the magazine 260 is loaded with cartridges, the magazine follower 263 is depressed and the magazine tab 165 does not extend upward sufficiently to activate the magazine catch 145 when inserted into the firearm 200. As cartridges are removed from the magazine 260 through firing the gun or manually activating the chamber, the magazine follower 263 rises until the magazine tab 165 extends out from the magazine housing 265. The magazine tab 165 is sized so that when the magazine 260 is empty the magazine tab 165 will engage with the magazine catch 145 (FIG. 1), activating the bolt hold-open device.

The bolt hold-open system 100 requires the use of a modified magazine in order to provide the improved functionality of automatically holding the bolt open when the magazine is empty. However, a firearm modified with the locking assembly 105 of the bolt hold-open system too of the present invention can nevertheless be used with unmodified magazines. If an unmodified magazine is used in a firearm modified with the locking assembly 105 must be manually activated by raising the activator lever 130 (FIG. 2).

Some firearms that are fundamentally compatible with the locking assembly 105 of the current invention nevertheless have a cartridge chambering mechanism that does not allow for the addition of a rear tab to the magazine. FIG. 6 illustrates a second embodiment of the locking assembly 105 and a second alternative variation of the modified magazine of the bolt hold-open system too for use in such firearms. In this aspect an alternative magazine 270 is used with a magazine side tab 167 mounted to the front right side of the alternative magazine follower 273. The magazine side tab 167 extends in an arc upward and to the right to engage with the magazine side catch 147 (FIG. 6).

FIG. 7 provides a perspective view of a standard alternative magazine 270 modified for use in the second alternative embodiment of the locking assembly 105. Like in the magazine 260 (FIG. 5) that is compatible with a rear magazine tab 165 (FIG. 5), when the alternative magazine 270 has cartridges in it, the magazine side tab 167 does not extend upward sufficiently to engage the magazine side catch 147. As the magazine 270 is emptied, the alternative magazine follower 173 rises, causing the magazine side tab 167 to rise as well. The magazine side tab 167 is sized so that when the alternative magazine 270 is empty of cartridges the magazine side tab 167 will extend sufficiently out of the body 265 of alternative magazine 270 to push up the magazine side tab 167 to engage with the magazine side catch 147, thus activating the locking assembly 105.

A third embodiment of the locking assembly 105 is seen in FIGS. 10-13. The locking assembly 105 of this third embodiment is similar to the locking assembly 105 of the first embodiment of FIGS. 1-4, 8-9 with a variation in the piece of the bolt hold-open that engages the rifle bolt carrier 230, which in this embodiment is the upper carrier-interacting portion 119 of the bolt catch lever no.

The rear end of the bolt catch lever no of the third embodiment is shaped into one rearwardly projecting portion lower prong 113 and an upper carrier-interacting portion 119. The upper carrier-interacting portion 119 is an upwardly extending portion at the rear of lever no. The upper carrier-interacting portion 119 has a step- or hook-shaped upper engagement section, best seen in FIG. 13. For use with most AK-47 variants, the upper carrier-interacting portion 119 will extend slightly higher than the upper carrier-interacting portion 112 of the first embodiment. The top front edge of the hook-shaped upper engagement section is positioned above the cut-out defined by edge 222 on the lower side of bolt catch lever no and, in one aspect, may be generally centered over the cut-out. The hook-shaped upper engagement section extends generally horizontally from the top front edge to the top back edge. The top back edge of upper carrier-interacting portion 119 is positioned above the forward portion of bolt catch lever lower prong 113. The upper carrier-interacting portion 119 of the third embodiment does not extend as far rearward as the upper carrier-interacting portion 112 of the first embodiment.

The bolt catch lever no of the third embodiment functions as described above in the first embodiment, with the change that the hook-shaped upper engagement section of the upper carrier-interacting portion 119 rises into the path of the rifle bolt carrier 230 and engages the front of the rifle bolt carrier 230 instead of the rear as in the first embodiment. The hook or step shape may be slightly wider or taller, as needed to allow the hooked-shaped upper engagement section of the upper carrier-interacting portion 119 to go around or avoid the edge of the rail of the gun interior.

The magazine lever 140 (rotatably connected to bolt catch lever no at the magazine lever pivot 115) of the third embodiment has a half-arch shaped rear tab 143 that ends in a generally horizontal edge 151, in contrast to the straight tab 143 of the first embodiment.

Though not depicted, the locking assembly 105 of the third embodiment may also be used with the alternative magazine follower 273 and the alternative magazine side tab 167 of the second embodiment of the locking assembly 105. The locking assembly 105 of the third embodiment may also be used with either the left-side activator lever connector 155 (FIG. 3), the right-side activator lever connector 135 (FIG. 2), or the combined left-side activator lever connector 155 and the right-side activator lever connector 135.

The locking assembly 105 of the third embodiment provides all of the functionality of the locking assembly 105 of the first embodiment. The third embodiment of the locking assembly 105 is useful in AK-47 variants that have been conformed to fall within the requirements of the laws of multiple states of the United States. These laws require the removal of the knob on the back of rifle bolt carrier 230 that is engaged in the first embodiment.

To use the bolt hold-open system 100, if a gun has been fired and there are no additional cartridges in the magazine, the magazine tab 165 (FIG. 5) will raise the magazine catch 145 causing the magazine lever pivot 115 to rise. This action rotates the bolt catch lever upward with the hammer pivot pin 220 serving as a fulcrum. The bolt catch lever upper carrier-interacting portion 112, 119 moves upward into the path of the bolt carrier 230, catching it and preventing it from returning to the starting position. After the magazine 260, 270 is ejected the tension of the bolt carrier 230 pressing on the bolt catch lever upper carrier-interacting portion 112, 119 will keep the bolt catch lever 110 in place until the activator lever 130 (FIG. 2) is pressed down. When the activator lever 130 (FIG. 2) is pressed down, it will rotate causing the connector lever 120 (FIG. 1) to rotate as well. The connector lever 120 is connected at the forward end to the bolt catch lever lower prong 113 (FIG. 4), so the rotation of the connector lever 120 will cause the bolt catch lever 110 to rotate downward around the hammer pivot pin 220. This downward rotation will cause the bolt catch lever upper carrier-interacting portion 112, 119 to lower out of the path of the bolt carrier 230, allowing the bolt carried by bolt carrier 230 to return to its starting position. If a new magazine 260 (FIG. 5), 270 (FIG. 7) is inserted before activating the activator lever 130, the bolt will load the first cartridge from the new magazine into the chamber.

From the foregoing, it will be apparent that the bolt hold-open system 100 of the current invention provides a system and method of operation that is easily adaptable to a wide variety of guns, requires minimal modifications to the guns, is convenient to use, increases the speed with which a shooter can chamber a new round after emptying a magazine, and which allows the use of unmodified magazines without affecting the normal function of the gun.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

I claim:

1. A bolt hold-open system for mounting in a firearm with a firearm casing, hammer pin, and trigger pivot pin, said bolt hold-open system comprising a locking assembly, said locking assembly comprising:

a bolt catch lever extending longitudinally with a front end, a mid-section, and a rear end; wherein said rear end comprises an upper carrier-interacting portion; wherein said bolt catch front end is configured with a hammer pin aperture configured to receive said hammer pin of said firearm, by which said bolt catch lever rotates with respect to said hammer pin:

a magazine lever with a forward end and a rear tab, wherein said magazine lever is rotatably mounted to said bolt catch lever at a magazine lever pivot; and wherein said magazine lever rear tab is configured to rest on said trigger pivot pin of said firearm;

a manual activator lever disposed on the exterior of said casing of said firearm;

an activator lever connector that passes from the inside to the outside of said casing of said firearm and that is non-rotatably connected to said manual activation lever; and a connector lever having a front end and a rear end, wherein:

said connector lever front end is rotatably connected to said bolt catch lever; and said connector rear end is non-rotatably connected to said manual activator lever via said activator lever connector; wherein said bolt catch lever has a lower edge configured with a U-shaped trigger pin cut-out edge defining a trigger pin cut-out positioned to prevent interaction with said trigger pivot pin of said firearm.

2. The bolt hold-open system as recited in claim 1 wherein said magazine lever further comprises a magazine catch disposed at said forward end of said magazine lever.

3. The bolt hold-open system as recited in claim 2 further comprising a magazine, said magazine comprising:

a magazine body;

a magazine follower disposed within said magazine body; and a magazine tab attached to the rear portion of said magazine follower, wherein, when said magazine is empty, said magazine follower is in a raised position with said magazine tab extending upward at least to the top of a rear portion of said magazine body to accommodate engagement with said magazine catch.

4. The bolt hold-open system as recited in claim 2 further comprising a magazine, said magazine comprising:

a magazine body;

a magazine follower disposed within said magazine body; and a magazine tab attached to the side portion of said magazine follower, wherein, when said magazine is empty, said magazine follower is in a raised position with said magazine tab extending upward at least to the top of a side portion of said magazine body to accommodate engagement with said magazine catch.

5. The bolt hold-open system as recited in claim 1 wherein said upper carrier-interacting portion is disposed rearward of said magazine lever pivot.

6. The bolt hold-open system as recited in claim 1 wherein said upper carrier-interacting portion comprises an upper prong extending rearward of said magazine lever pivot.

7. The bolt hold-open system as recited in claim 1 wherein said magazine lever rear tab has a straight shape.

8. The bolt hold-open system as recited in claim 1 wherein said magazine lever rear tab has a half-arch shape.

9. The bolt hold-open system as recited in claim 1 wherein said manual activator lever comprises at least one of a right-side activator lever connector, a left-side activator lever, or a combined right-side and left-side activator lever connector.

10. A bolt hold-open system for mounting in a firearm with a firearm casing, hammer pin, and trigger pivot pin, said bolt hold-open system comprising a locking assembly, said locking assembly comprising:

a bolt catch lever extending longitudinally with a front end, a mid-section, and a rear end; wherein said rear end comprises an upper carrier-interacting portion; wherein said bolt catch front end is configured with a hammer pin aperture configured to receive said hammer pin of said firearm, by which said bolt catch lever rotates with respect to said hammer pin;

a magazine lever with a forward end and a rear tab, wherein said magazine lever is rotatably mounted to said bolt catch lever at a magazine lever pivot; and wherein said magazine lever rear tab is configured to rest on said trigger pivot pin of said firearm;

a manual activator lever disposed on the exterior of said casing of said firearm;

an activator lever connector that passes from the inside to the outside of said casing of said firearm and that is non-rotatably connected to said manual activation lever; and a connector lever having a front end and a rear end, wherein:

said connector lever front end is rotatably connected to said bolt catch lever; and said connector rear end is non-rotatably connected to said manual activator lever via said activator lever connector;

wherein:

said magazine lever pivot is located in the mid-section of said bolt catch lever; and said magazine lever pivot is located forward of said rear tab of said magazine lever.

11. The bolt hold-open system as recited in claim 10 wherein said magazine lever further comprises a magazine catch disposed at said forward end of said magazine lever.

12. The bolt hold-open system as recited in claim 11 further comprising a magazine, said magazine comprising: a magazine body; a magazine follower disposed within said magazine body; and a magazine tab attached to a rear portion of said magazine follower, wherein, when said magazine is empty, said magazine follower is in a raised position with said magazine tab extending upward at least to the top of a rear portion of said magazine body to accommodate engagement with said magazine catch.

13. The bolt hold-open system as recited in claim 11 further comprising a magazine, said magazine comprising: a magazine body; a magazine follower disposed within said magazine body; and a magazine tab attached to a side portion of said magazine follower, wherein, when said magazine is empty, said magazine follower is in a raised position with said magazine tab extending upward at least to the top of a side portion of said magazine body to accommodate engagement with said magazine catch.

14. The bolt hold-open system as recited in claim 10 wherein said upper carrier-interacting portion is disposed rearward of said magazine lever pivot.

15. The bolt hold-open system as recited in claim 10 wherein said upper carrier-interacting portion comprises an upper prong extending rearward of said magazine lever pivot.

* * * * *